United States Patent [19]

Karm

[11] 4,333,502

[45] * Jun. 8, 1982

[54] FORMING FABRICS FOR PAPER-MAKING MACHINES AND METHODS OF MANUFACTURE THEREOF

[75] Inventor: Robert Karm, Selestat, France

[73] Assignee: Martel Catala & Cie, Selestat, France

[ * ] Notice: The portion of the term of this patent subsequent to Oct. 16, 1996, has been disclaimed.

[21] Appl. No.: 35,416

[22] Filed: May 2, 1979

Related U.S. Application Data

[63] Continuation-in-part of Ser. No. 780,249, Mar. 22, 1977, Pat. No. 4,171,009.

[30] Foreign Application Priority Data

Nov. 7, 1977 [FR] France ..... 77 33394

[51] Int. Cl.[3] ..... D03D 15/00; D03D 15/02; B21F 1/10; B10D 39/08

[52] U.S. Cl. ..... 139/425 A; 139/413; 162/DIG. 1; 162/348

[58] Field of Search ..... 139/425 A, 425 R, 383 A, 139/408–413; 162/DIG. 1, 348, 349, 358; 245/2, 8, 10; 34/95

[56] References Cited

U.S. PATENT DOCUMENTS

| | | | |
|---|---|---|---|
| 3,915,202 | 10/1975 | Curtis et al. | 139/425 A |
| 4,041,989 | 8/1977 | Johansson et al. | 139/425 A |
| 4,071,050 | 1/1978 | Codorniu | 139/425 A |
| 4,112,982 | 9/1978 | Bugge et al. | 139/425 A |
| 4,157,276 | 6/1979 | Wandel et al. | 162/DIG. 1 |
| 4,171,009 | 10/1979 | Karm | 139/425 A |

OTHER PUBLICATIONS

*Advance Textile Design,* William Watson, Second Edition, Publ. by Longmans, Green and Co., 1925, pp. 1–12.

Technology of Textile Design, E. A. Posselt, 1896, pp. 25–30.

*Primary Examiner*—James Kee Chi

[57] ABSTRACT

An endless forming fabric for paper-making machine comprise at least two layers of transverse threads and one layer of longitudinal threads. The upper loops formed by the longitudinal threads cover from 3 to 7 transverse threads of the upper layer. The leading crossing points of these upper loops with the transverse threads are distributed in a weave pattern using at least five longitudinal threads. The weave pattern on the paper side of the fabric is selected so as to avoid alignment of the upper loops of adjacent threads and diagonal effects. The lower loops formed by the longitudinal threads, on the machine side of the fabric, pass each time only underneath a single transverse thread of the lower layer. The outer loops are so located that there is no gap in the longitudinal direction between each individual said outer loop of each said longitudinal thread and outer loops of the adjacent longitudinal threads.

9 Claims, 17 Drawing Figures

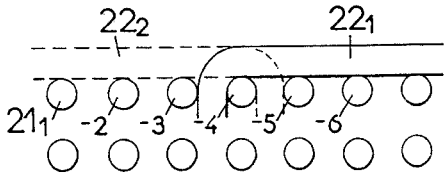
FIG.2.
FIG.3.
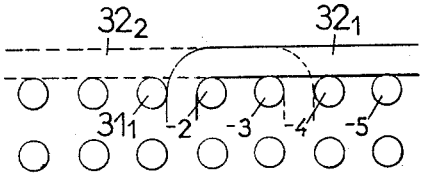
FIG.4.
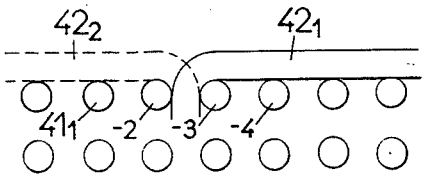
FIG.5.
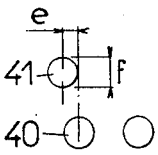
FIG.6.
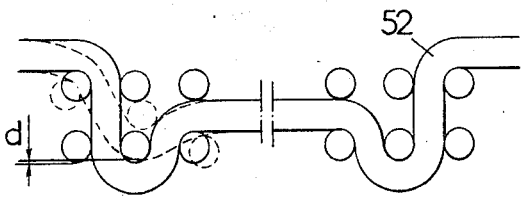

FORMING FABRICS FOR PAPER-MAKING MACHINES AND METHODS OF MANUFACTURE THEREOF

CROSS REFERENCES TO RELATED APPLICATIONS

This is a continuation-in-part of my copending application Ser. No. 780,249 filed Mar. 22, 1977 now U.S. Pat. No. 4,171,009 granted Oct. 16, 1979.

BACKGROUND AND SUMMARY OF THE INVENTION

The present invention relates to forming fabrics for paper-making machines, this term being understood in its widest sense to include in particular machines for the manufacture of paper pulp, cellulose, Kraft paper, cardboard etc. It relates more particularly to endless multiply or multilayer forming fabrics having at least two piles or layers of transverse threads (i.e. threads running transversely to the direction of movement of the forming fabric in the paper-making machine) and one layer or ply of longitudinal threads (i.e. running in the direction of movement of the fabric during operation).

In a paper-making Fourdrinier machine the paper sheet is generally formed either on an endless forming fabric, or between two endless forming fabrics, or between an endless forming fabric and other members such as hollow fabric-covered cylinders or heated cylinders. The endless fabrics may be entirely of threads or yarns of synthetic or metal material or they may include, in combination, metal threads and mono- or multifilament synthetic threads. The multifilament synthetic threads are obtained by spinning out synthetic fibres or endless synthetic fibres; they may also be made by twisting such threads. The synthetic material is generally polyester or polyamide although other polymers or copolymers can be used. Before or during manufacture of the forming fabrics, the threads may be coated with a synthetic material.

The forming fabrics for paper-making machines must fulfil conditions which are to some extent contradictory.

The transverse rigidity of the forming fabric should be as high as possible, especially for fabrics of great length and width (respectively up to approx. 80 m and 10 m) which move at high speeds (e.g. 1100 m/min.). Insufficient transversal rigidity may result in the formation in the fabric of a fold which first deteriorates the sheet of paper formed on the fabric and ultimately ruins the fabric.

To increase rigidity, "double ply" fabrics have been used instead of single ply fabrics which have a single layer of longitudinal threads and a single layer of transverse threads. Such fabrics have two layers of transverse threads which both contribute to increase the transverse stiffness which is consequently much higher than in single ply fabrics.

For simplicity's sake, I shall call "upper layer" the layer of transverse threads located on the paper side when the fabric is on the paper-making machine. The lower layer of transverse threads will be the layer which, on the paper-making machine, is on the side of the fabric supporting members and dewatering elements (foils, suction boxes and the like).

It is well known that the fabric must impress on the material to be formed (typically a sheet of paper) a roughness or "mark" as faint as possible. Numerous attempts have been made to reduce the mark. Grinding the fabrics prior to use to make smoother the surface in contact with the paper has been proposed. But while the marks are less deep, they are wider. The number of threads per unit of surface has been increased to support the sheet of paper on a fabric having as many contact points as possible with the paper sheet but it results in a finer, therefore less resistant, fabric.

Up to now, it was generally felt that, in order to reduce the mark, it was advisable to increase the number of crossing points between longitudinal and transverse threads of the upper layer and to arrange that the outer surfaces of the undulations formed by all the threads towards the side of the sheet of paper are approximately tangential to a same plane. Such an assumption has led to use double layer fabrics wherein the longitudinal threads and the transverse threads of the upper layer are interwoven according to a "plain" weave at each crossing point, i.e. each longitudinal thread or yarn binds separately with one transversal thread or yarn of the upper layer at each crossing point.

Furthermore, the paper forming fabrics must have as high a resistance to abrasion as possible. In paper-making machines, the fabrics are supported on the inside by abrasive members, some of which support the fabric to keep it flat while others exert a suction on it to eliminate through the fabric a great part of the water in which the cellulose fibres and additives forming the paper pulp are in suspension.

The dewatering elements wear the fabric which must be replaced after a period of use. One of the principal concerns of manufacturers has been to increase the resistance to abrasion of the forming fabrics. For that purpose, attempts have been made to replace polyester yarns with polyamide yarns which are more resistant to abrasion. Unfortunately, the more abrasion resistant yarns are more flexible than the polyester yarns and it has been found that polyamide fabrics lack transverse stiffness and stretch too much under the tension necessary for use in paper-making machines.

It is a first object of the invention to provide an improved multilayer fabric for forming paper and the like which has a high transverse stiffness and at the same time does not impress an excessive mark on the paper.

It is another object to provide a multiply or multilayer forming fabric for a Fourdrinier machine which has a high resistance to wear by abrasion and consequently a long useful life.

An important step in conceiving the present invention was the determination of the surprising fact that the transverse threads mark the paper more than the longitudinal threads, even when the sheet of paper is supported by a fabric whose longitudinal and transverse threads have outer surfaces which are tangential to a same plane on the paper supporting side. That may be due to the anisotropy of the paper caused by the orientation given to the cellulose fibres during manufacture of the paper. That finding is used by providing a multilayer fabric in which the threads are so interwoven that the outer loops formed by the longitudinal threads contacting the paper on the paper supporting side of the fabric, cover from three to seven transverse threads of the upper layer, the first crossing points of said outer loops and transverse threads being distributed according to a repeating weaving pattern comprising at least five longitudinal threads. The weaving pattern on the paper side of the fabric is additionally selected so as to avoid full alignment of said outer loops on adjacent threads and diagonal effects. The outer loops formed by the longitudinal threads on the machine side of the fabric pass each time only under a single transverse thread of the lower layer. The outer loops are so arranged that there is no gap in the direction of the longitudinal threads between the outer loops of each longitudinal thread and the outer loops of the adjacent longitudinal threads.

Preferably, the "filling coefficient" for the longitudinal threads (i.e. the cumulative width of the longitudinal threads—supposed to be side by side—per unit width of the fabric) is between 1.05 and 2.0.

The fabric typically has two layers of transverse threads and a layer of longitudinal threads all of synthetic material, is flat woven and junctioned to make it endless. The upper loops formed by the longitudinal threads (warp threads) of synthetic material on the paper receiving side of the fabric cover from three to seven transverse threads (generally three or four transverse threads) of the upper layer. The first crossing points of the loops with the transverse threads may be distributed according to a satin weave of at least five threads. The lower loops formed by the longitudinal threads on the machine side of the fabric pass each time only under one transverse thread of the lower layer.

Advantageously, the transverse threads of the lower layer may have different characteristics from those of threads used for the other layer(s) of transverse threads and may have a higher resistance to abrasion. The transverse threads of at least one of the layers can have a diameter greater than that of the longitudinal threads, the ratio between the diameters being then advantageously equal to 1.05 at least and 2.5 at most, different threads may be used (for instance alternate polyester and polyamide threads).

The forming fabric is advantageously woven, or treated after weaving (e.g. subjected to a fixing heat treatment while maintained under longitudinal tension) under such conditions that, when the fabric is new, only transverse threads are in contact with the fabric supporting members of the machine.

The invention will be better understood from the following description of particular embodiments given by way of examples.

SHORT DESCRIPTION OF THE DRAWINGS

FIG. 1*a* is a diagrammatic cross section along line A—A of FIG. 1*b* of a portion of a first fabric;

FIG. 1*b* is a diagram showing the weaving pattern of the fabric of FIG. 1*a* as seen from the paper side (upper layer);

FIGS. 2, 3 and 4 are sectional views along a plane parallel to the longitudinal threads of the fabric, illustrating various considerations of the longitudinal wires according to particular embodiments of the invention;

FIG. 5 is a schematic cross section along a plane parallel to the longitudinal threads, which indicates a preferred arrangement of the transverse threads of the two layers;

FIG. 6 is a schematic cross section along a plane parallel to the direction of the longitudinal threads, for illustrating an other aspect of the invention;

Figure 1A:
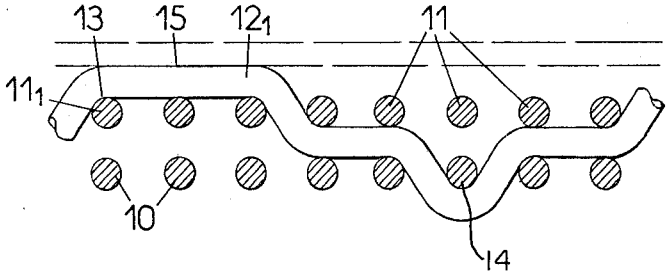
Figure 1B:
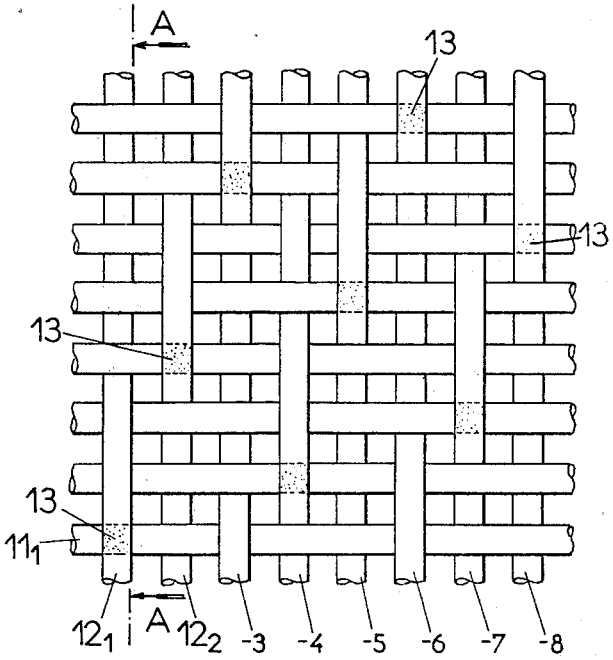

FIGS. 7*a*–7*b*, 8*a*–8*b*, 9*a*–9*b*, 10*a*–10*b* and 11*a*–11*b*, similar to FIGS. 1*a*–1*b*, illustrate five particular embodiments of the invention, each figure whose number bears the affix a being a cross section along direction AA of the figure having the same number with the index b.

DETAILED DESCRIPTION OF PREFERRED EMBODIMENTS

As indicated above, the fabrics are typically woven so that the filling coefficient for the longitudinal threads is 1.05 or more, typically 1.2. However, for more clarity, the diagrams of the drawings correspond to filling coefficients which are much smaller and in addition the threads are represented at even intervals rather than in their actual respective locations.

Taking into account the high value of the filling coefficient, it will be appreciated that the sheet of paper is essentially supported by long loops of the longitudinal threads, which do not exhibit abrupt curvatures or "knees" at the crossing points with the cross machine threads. The mark impressed on the sheet of paper is thereby considerably diminished.

Referring to FIGS. 1*a* and 1*b*, there is shown a fragment of a paper forming fabric which has a lower layer of transverse threads 10 and an upper layer of transverse or cross-machine threads 11 connected by longitudinal threads $\mathbf{12}_1$, $\mathbf{12}_2$, . . . , $\mathbf{12}_8$. Assuming that the fabric has been flat woven and then junctioned by splicing the ends, the longitudinal threads are formed by warp threads and the transverse threads by weft threads.

Each longitudinal thread 12 passes successively, from a crossing point 13 at which it passes from under to above the upper layer of threads 11, over three transverse threads 11, then between two threads 11 and the two associate threads 10 of the lower layer, then under one transverse thread 10 of the lower layer with which it has a plain binding, then between two threads 11 and the two corresponding threads 10; the pattern then is repeated.

As shown on FIG. 1*b*, the points 13 are distributed according to an eight thread satin weaving pattern with a shift of three between two successive longitudinal threads; they are indicated with shaded areas in FIG. 1*b*.

Each loop 15 over the upper layer binds three threads 11. Each loop 14 of a longitudinal thread below the lower layer binds with or passes under a single thread 10 of this layer. Due to this arrangement and taking into account the tension exerted on the warp threads during weaving and/or finishing treatments, the longitudinal thread 12 forces the bindings with the transverse threads of the lower layer 10 inwardly. Thus the transverse threads 10 remain on the surface of the fabric, on the machine side and the longitudinal threads are "buried" in the fabric and they are tangent to a plane deeper in the fabric than the plane tangent to the outer surfaces of the cross machine threads 10.

As a consequence, the lower surface of the fabric is principally covered by transverse threads 10 which withstand the abrasion caused by the machine elements. The wear of the fabric affect the longitudinal threads 12 only after wear out from the transverse threads 10 of material. The fabric has then the advantage that the wear does not affect the tensile strength of the fabric before the transverse threads have worn to a considerable amount.

Due to the inherent transverse rigidity of multiply fabrics, a thread selected taking into account other requirements can be used for one of the layers. This thread can have characteristics different from those of the threads of the other layers without loss of the transverse stiffness necessary for proper operation in a paper-making machine. The different characteristics can be chemical composition, resistance to abrasion, stiffness, tensile strength, resilient yield, etc.

A fabric can be made for example having lower layer transverse threads 10 with a better resistance to abrasion than the other threads 11 and 12; this fabric, whose transverse threads of lower layer 10 will withstand abrasion, will last longer. Among the special threads having a better abrasion resistance than polyester monofilament threads used currently in the manufacture of forming fabrics, are polyamide monofilaments, different types of coated multifilaments, and threads coated with a resin highly resistant to abrasion, such as certain polyurethanes. Special threads having a low stiffness can be accepted, up to the point that if the special threads were used for manufacturing the whole fabric, the fabric would be unusuable in a paper-making machine due to lack of transverse stiffness.

For certain uses, the embodiment of FIGS. 1*a*–1*b* has been found not fully satisfactory and an attempt may be made to explain the origin of the problem. Referring to transversal thread $\mathbf{11}_1$, in the lower portion of FIG. 1*b*, that thread is located under longitudinal threads $\mathbf{12}_1$, $\mathbf{12}_3$ and $\mathbf{12}_6$ and above $\mathbf{12}_2$, $\mathbf{12}_4$–$\mathbf{12}_5$, $\mathbf{12}_7$ and $\mathbf{12}_8$. Since an actual fabric has a filling coefficient for the longitudinal thread which is much higher than that indicated in sketch form on FIG. 1*b* for clarity and typically is 1.05 or more, the transversal threads of the upper layer are not substantially curved and are located at a distance from that external plane which is tangent to the loops or floats of the longitudinal threads on the paper-bearing side of the fabric. At the locations where thread $\mathbf{11}_1$ is above two adjacent longitudinal threads, for instance $\mathbf{12}_4$ and $\mathbf{12}_5$, or $\mathbf{12}_7$ and $\mathbf{12}_8$, the fabric has a recess or gap which increases the overall roughness of the fabric due to the transversal threads being located deeper than the longitudinal threads in the fabric.

FIGS. 2, 3 and 4 illustrate several arrangements according to the invention which overcome the difficulty.

In the embodiments of FIGS. 2 and 3, the long upper loops of the longitudinal threads above the upper layer of transverse thread are disposed so that there is an overlap of each upper loop with the upper loops of the adjacent longitudinal threads. Referring to FIG. 2, the loop of longitudinal thread $\mathbf{22}_1$ above upper transverse threads $\mathbf{21}_4$, $\mathbf{21}_5$, $\mathbf{21}_6$ has an overlap of one thread with the upper loop of the adjacent longitudinal thread $\mathbf{22}_2$. Referring to FIG. 3, the adjacent longitudinal threads $\mathbf{32}_1$ and $\mathbf{32}_2$ form upper loops having an overlap over two successive transverse threads $\mathbf{31}_2$ and $\mathbf{31}_3$.

In FIG. 4, the upper loop of a longitudinal thread $\mathbf{42}_1$ terminates in a portion which projects from the paper side surface to the other side of the paper making fabric at the same point where the adjacent longitudinal thread $\mathbf{42}_2$ projects between two upper transverse threads $\mathbf{41}_2$ and $\mathbf{41}_3$ to form an upper loop above the upper layer of transverse threads.

Paper-making fabrics should allow water to flow readily through for the sheet of paper which leaves the forming section of the machine to be sufficiently dry to be removed without difficulty. For that draining to be satisfactory, it is of interest to fulfil the condition shown in FIG. 5: in any longitudinal vertical plane through the fabric, the average offset e between the axis of an upper transverse thread 41 and the axis of the corresponding transverse thread 40 in the lower layer is equal to or less than the diameter f of the upper transverse thread 41.

For easier weaving of double-layer fabrics, it is desirable to provide each longitudinal thread with a portion passing between the upper and lower layers of transverse threads between a lower loop and an upper loop thereof, each said portion corresponding to one or two pairs of corresponding transverse threads in the lower and upper layer.

In the embodiment illustrated in FIG. 1*a*, portions of thread $\mathbf{12}_1$ each extend between the two layers over a length corresponding to two pairs of superposed transverse threads.

In another embodiment illustrated in FIGS. 4 and 5 of copending application Ser. No. 780,249, the longitudinal thread passes between the two layers of transverse threads over a length corresponding to one pair of superposed transverse threads. The provision of that portion increases the number of harnesses required for weaving the fabric. In a particular embodiment of the invention, the weaving pattern is so selected that the portion between each upper loop or float of the lower loop which follows and binds with a single thread of the lower layer only, is directly through the two layers, without the longitudinal thread passing between the upper and lower layers of transverse threads.

Two advantages result from that construction: slip of the transverse threads of the same pair with respect to each other is decreased, whereby the condition shown in FIG. 5 is easier to fulfil; the number of harnesses required for weaving is decreased.

Such an arrangement, in which the longitudinal thread 52 passes directly from the lower loops to the upper loops, is illustrated in FIG. 6. There is further illustrated in FIG. 6 a result which may be inherently attained with the contexture of the invention, comprising long floats above the upper layer and lower loops each binding a single thread of the lower layer. Due to the tensile forces applied during the manufacture of the fabric, the lower loops are "embedded" in the thickness of the fabric and are deeper than the lower transverse threads by a distance d which will typically be about half the diameter of the transverse threads. This deformation is illustrated in dashes in FIG. 6.

Referring to FIGS. 7 to 11, there are shown several other embodiments.

Figure 7A:
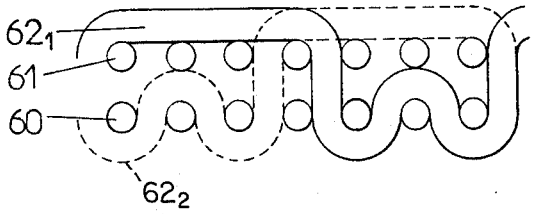
Figure 7B:
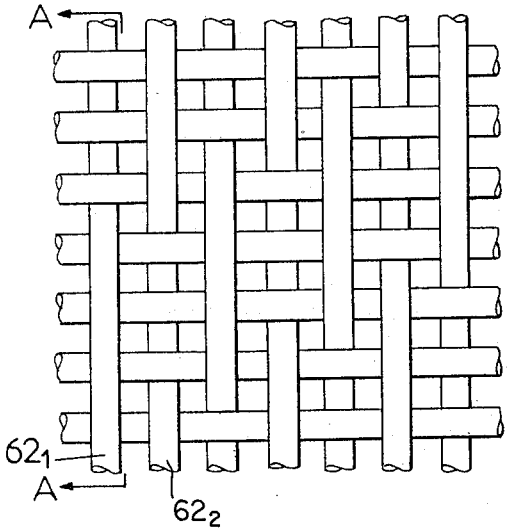

In FIGS. 7*a* and 7*b* (where two successive longitudinal threads $\mathbf{62}_1$ and $\mathbf{62}_2$ are shown one with a continuous line, the other with a dash line), there is illustrated a paper forming fabric in which the first crossing points of the loops over the upper layer 61 are distributed in a satin weave of seven threads, with a shift of two threads. The longitudinal threads have upper floats over four threads on the paper supporting side. They project directly through the fabric from the upper loops to the lower loops under the underlayer 60.

Figure 8A:
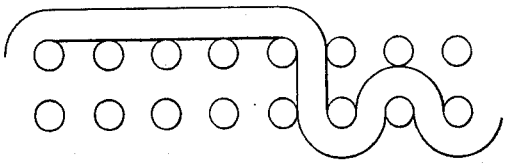
Figure 8B:
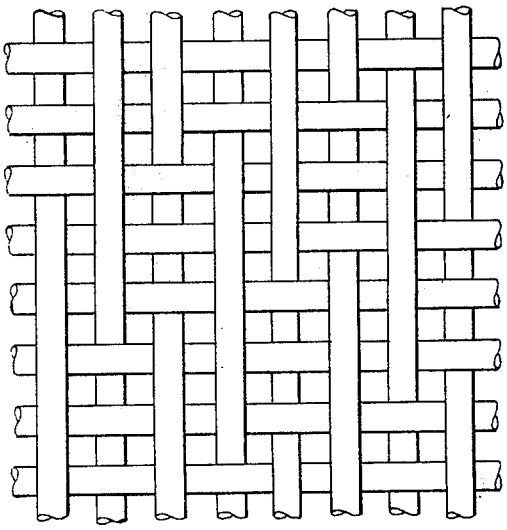

In the embodiment shown in FIGS. 8*a* and 8*b*, the crossing points are distributed in a satin weave of eight, with a shift of three. The longitudinal threads comprise upper floats over five threads on the paper side.

Figure 9A:
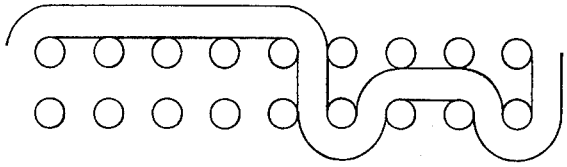
Figure 9B:
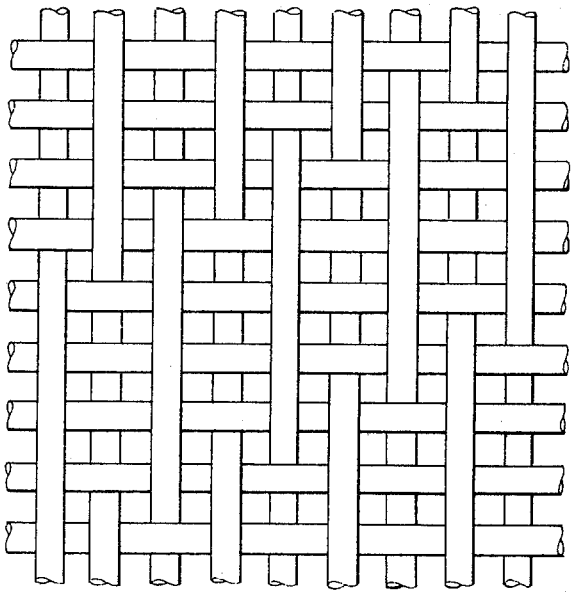

FIGS. 9*a* and 9*b* illustrate a fabric in which the crossing points are distributed in a satin weave of nine with a shift of two. The longitudinal threads have upper floats over five threads on the paper side.

Figure 10A:
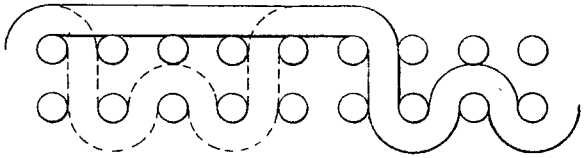
Figure 10B:
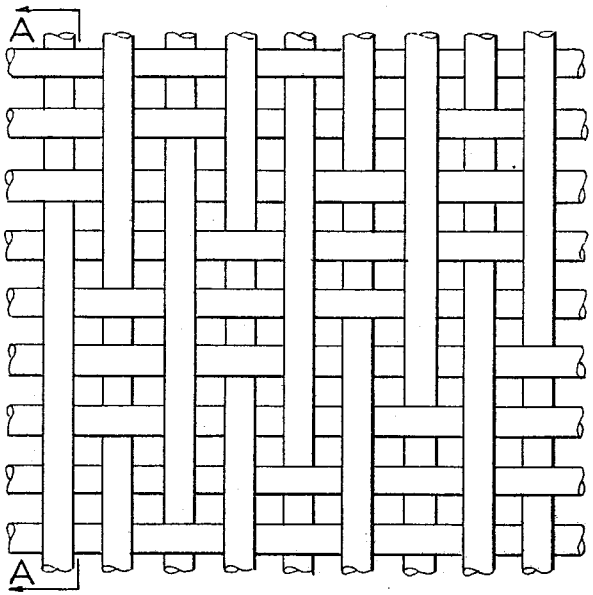

FIGS. 10*a* and 10*b* illustrate still another fabric, in which the crossing points are distributed in a satin weave of nine with a shift of two. The longitudinal threads have upper floats of six threads on the paper side. They pass directly from the upper floats to the lower loops. Two adjacent upper floats have overlaps corresponding respectively to one and two upper transverse threads.

Figure 11A:
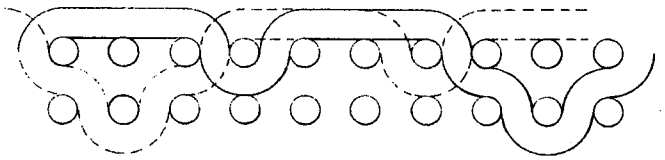
Figure 11B:
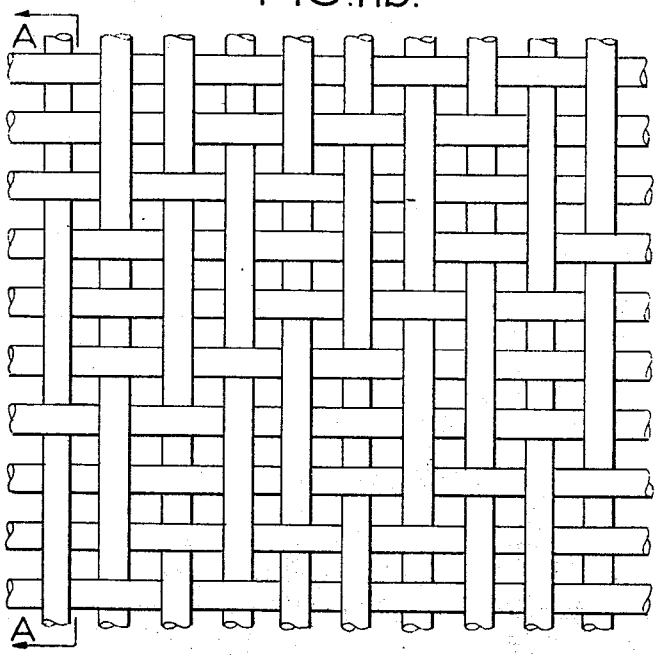

In the embodiment shown in FIGS. 11*a* and 11*b* (satin weave of ten with a shift of three), each longitudinal thread comprises, between two successive lower loops, two upper floats of three. The path of each longitudinal thread from an upper float to a lower loop (or the reverse) is located between the transverse threads of a single pair.

FIGS. 7 to 11 are diagrams provided for purposes of explanation only. The longitudinal threads at a distance much smaller than shown and the threads are not distributed according to a perfect rectangular network, as will be immediately apparent to those competent in the paper making fabrics art.

I claim:

1. Endless forming fabric for paper-making machine and the like, comprising:

an upper layer of threads transverse to the direction of movement of the fabric on the machine and located on the material forming side of the fabric, a lower layer of threads transverse to said direction of movement and located on the wear side of the fabric, and longitudinal threads interwoven with the layers of transverse threads, wherein all outer loops formed by the longitudinal threads over the transverse threads of the upper layer bind with from 3 to 7 transverse threads of the upper layer and the first points of crossing of said outer loops with the transverse threads are distributed according to a weaving pattern comprising at least five longitudinal threads, and the weaving pattern on the outer surface of the fabric which supports the material to be formed is of a type without alignments of said loops on adjacent threads and without diagonal effects, wherein the longitudinal threads from lower loops each binding with one transverse thread of the lower layer on the wear side of the fabric, and wherein said outer loops formed by the longitudinal threads over the transverse threads of the upper layer are so located that there is no gap in the longitudinal direction between each individual said outer loop of each said longitudinal thread and outer loops of the adjacent longitudinal threads.

2. Endless forming fabric for paper-making machine and the like, comprising:

an upper layer of synthetic threads transverse to the direction of movement of the fabric on the machine and located on the material forming side of the fabric, a lower layer of synthetic threads transverse to said direction and located on the wear side of the fabric, and synthetic longitudinal threads interwoven with the layers of transverse threads, wherein:

the longitudinal threads form outer loops whose outer surfaces constitute the paper forming surface over the threads of said upper layer, each loop covering a plurality of threads of the upper layer, the first points of crossing of said loops with the upper layer are distributed according to a satin weave pattern of at least five threads in either direction, and said outer loops are located and arranged for suppressing gaps in the longitudinal direction between the outer loops of each longitudinal thread and the outer loops of the adjacent longitudinal threads.

3. A fabric according to claim 1 or 2, wherein the last crossing points of the outer loops of each said longitudinal thread over the transverse threads of the upper layer are distributed according to a satin weave pattern comprising at least six longitudinal threads are located between the same transverse threads as the first crossing points of the outer loops of one of said adjacent threads.

4. A fabric according to claim 2, wherein each outer loop of each said longitudinal thread has a longitudinal overlap with outer loops of an adjacent longitudinal threads.

5. A fabric according to claim 2, wherein each said longitudinal thread crosses both layers of transverse threads at both ends of said outer loops and passes directly from under said lower layer up to over said upper layer without any intermediary path portion between corresponding transverse threads of the two transverse layers.

6. A fabric according to claim 5, wherein the average offset in the longitudinal direction between two corresponding transverse threads in said upper layer and lower layer is smaller than the diameter of the transverse thread in the upper layer.

7. A fabric according to claim 2, wherein the longitudinal threads are inwardly offset with respect to the plane tangent to the outer surfaces of the transverse threads of said lower layer.

8. A fabric according to claim 2, wherein the filling coefficient of the longitudinal threads is at least 1.05.

9. A fabric according to claim 2, wherein the transverse threads of the lower layer have characteristics which are different from those of the threads of the upper layer.

* * * * *